US005620105A

United States Patent [19]

Macek

[11] Patent Number: 5,620,105

[45] Date of Patent: Apr. 15, 1997

[54] STORAGE CADDY

[75] Inventor: Thomas J. Macek, Chicago, Ill.

[73] Assignee: Selfix, Inc., Chicago, Ill.

[21] Appl. No.: 504,560

[22] Filed: Jul. 20, 1995

[51] Int. Cl.[6] ..... A47F 5/00

[52] U.S. Cl. ..... 211/119; 211/70.6; D6/525; D6/527

[58] Field of Search ..... 211/119, 113, 211/106, 70.6, 60.1; D6/525, 526, 527, 537

[56] References Cited

U.S. PATENT DOCUMENTS

| | | | |
|---|---|---|---|
| D. 195,452 | 6/1963 | Bernay | D4/3 |
| D. 288,510 | 3/1987 | Shames et al. | D6/525 |
| D. 292,256 | 10/1987 | Chap | D6/525 |
| D. 298,990 | 12/1988 | Chap | D6/525 |
| D. 320,134 | 9/1991 | Emery | D6/525 |
| D. 324,463 | 3/1992 | Young | D6/525 |
| D. 349,205 | 8/1994 | Khuhawar | D6/525 |
| D. 368,614 | 4/1996 | Munoz | D6/525 X |
| 1,039,359 | 9/1912 | Brown | 211/119 |
| 1,259,623 | 3/1918 | Herrick | 211/70.6 X |
| 2,518,549 | 8/1950 | Hyde | 211/106 |
| 2,643,003 | 6/1953 | Christie | 211/119 |
| 2,743,020 | 4/1956 | Rubenstein | 211/50 |
| 2,917,356 | 12/1959 | DaCruz | D6/527 X |
| 3,088,597 | 5/1963 | Ritchey | 211/13 |
| 3,115,107 | 12/1963 | Glenny | 108/152 |
| 3,181,702 | 5/1965 | Raphael | 211/119 |
| 3,789,996 | 2/1974 | Stroh | 211/119 |
| 3,900,110 | 8/1975 | Soroka | 211/113 |
| 3,923,162 | 12/1975 | Hussey | 211/119 |
| 4,053,954 | 10/1977 | Chapman | D6/525 X |
| 4,387,811 | 6/1983 | Ragir et al. | 211/119 |
| 4,573,591 | 3/1986 | Chap | 211/113 |
| 5,180,067 | 1/1993 | Conaway et al. | 211/119 |

FOREIGN PATENT DOCUMENTS

| | | | |
|---|---|---|---|
| 817019 | 7/1957 | United Kingdom | 211/181 |

OTHER PUBLICATIONS

One page from Lillian Vernon Catalog "Hold Everything", Apr. 1991, p. #unknown.

One page from Lee/Rowan Catalog "Space Solvers–Storage Solvers", date unknown, page unknown.

One page from Grayline catalog, Title unknown, date, unknown, p. 6.

*Primary Examiner*—Robert W. Gibson, Jr.

*Attorney, Agent, or Firm*—Dressler, Goldsmith, Milnamow & Katz, Ltd.

[57] ABSTRACT

A storage caddy for personal care products comprising a support portion for supporting said storage caddy in a selected position, a shelf portion for supporting selected personal care products, and a hanger or article receiving and retaining portion for supporting articles suspended therefrom. The hanger or article receiving and retaining portion includes a pair of spaced apart elongated hanger members for supporting at least a portion of selected personal care products. The spaced apart elongated hanger members are adapted to support thereon at least a portion of a personal care product of the type that can be selectively oriented in a position either to engage and be supported by said hanger members or in a position to pass through the enclosed space therebetween for insertion or removal. The elongated hanger members include a discontinuity such as an obstruction formed therein to inhibit reorientation of the selected personal care product from the hanger engaging position to the pass through position and the resultant inadvertent disengagement thereof from the caddy.

2 Claims, 2 Drawing Sheets

STORAGE CADDY

FIELD OF THE INVENTION

The present invention relates to storage caddies, and more particularly to storage caddies for personal care products used principally baths and showers.

BACKGROUND OF THE INVENTION

There are a wide variety of structures used to store personal care products, particularly in baths and showers. Many such structures, often referred to as shower caddies, are configured for mounting on a shower pipe in a bathtub or shower stall. One popular form of a shower pipe mounted shower caddy is illustrated in U.S. Pat. No. 4,387,811, assigned to Selfix, Inc., the assignee of the present application. Another form of a shower caddy is illustrated in U.S. Pat. No. 4,573,591, also assigned to Selfix, Inc.

The shower caddies illustrated in these patents are formed from plastic coated metal wire and from molded plastic. The caddies include an upper, generally inverted U-shaped gripping portion which receives the shower pipe on which the caddy is to be mounted. The gripping portion of these caddies define a relatively reduced throat area so that the gripping portion coacts with the shower pipe to resist both longitudinal and rotational movement. Such caddies when mounted on shower pipes are stable and secure in use, are resistant to tipping even if articles are placed off-center in a position that tends to cause the caddies to rotate about the shower pipe.

Other storage caddies may be mounted directly to the wall or other surface of the shower stall or bathroom by use of suitable devices, such as, for example, suction cups, and/or adhesive supports. Yet others may be free-standing.

Such storage caddies may include one or more shelves to provide a support or storage surface for various objects of personal care products, such as, for example, bars of soap, and bottles or tubes of shampoo and similar personal care products. If a shelf is provided for bottles and similar articles, storage caddies may also include a retaining member located above the shelf to help keep such articles in place. Often such shelves are porous. For example, the shelves in coated wire caddies are usually formed by a plurality of spaced apart wires. Alternatively, shelves may be tilted to facilitate drainage.

Other storage features are often included as well, such as, for example, projections, hooks and/or bars for wash cloths or other articles that can be hung on or draped over such projections. Often, articles are placed on such caddies for storage even though the caddies do not include features specifically designed therefor. Shower caddies, for example, are often used to store razors when not being used. The razors may be placed on a caddy shelf so the entire razor rests on the elongated shelf defining elements, e.g., spaced wires. Alternatively, razors may be hung from existing hooks or projections, may be inserted between the spaced wires of a shelf and positioned so the razor head hangs from a single wire, or may be rotated so the razor head rests on a pair of shelf wires. In both instances, the depending handle passes between and extends below the shelf wires.

While storing razors in this way is popular and convenient, it is not particularly secure. Razors often are knocked off of or otherwise dislodged from these relatively unstable perches. This is inconvenient and undesirable. For example, razors that drop often become misaligned and do a poor job of shaving when used thereafter.

Existing molded and similarly formed products include handle receiving apertures, e.g., for use with toothbrushes and razors. Such small special purpose openings are not as readily formed in wire type storage caddies. In some instances, molded or similar inserts are added. While these can provide the desired storage, they increase the cost of such caddies. In addition, there is only a limited amount of space available which restricts the number of different components that can be incorporated in caddies.

It would be desirable, therefore, to incorporate in such storage caddies a capability for easily receiving razors for storage, for providing for convenient retrieval of razors for use when desired, and for simultaneously reducing the likelihood of the razors being dislodged inadvertently. It would also be desirable to form any such structure in a way to incorporate other capabilities without significantly increasing the costs of such products.

SUMMARY OF THE INVENTION

In accordance with the present invention, there is provided a storage caddy for personal care products of the type which is typically used in showers and baths and which incorporates a multi-purpose razor receiving and retaining portion or element for facilitating the storage and retention of razors and which inhibits the inadvertent and accidental dislodgement of stored razors therefrom.

Storage caddies for personal care products incorporating the present invention may be designed to be mounted and supported on a shower pipe in the manner of many existing shower caddies, may be mounted on other support surfaces such as walls or cabinets, may be self-supporting, or may be an adjunct to such storage caddies.

A storage caddy for personal care products incorporating the present invention includes a support portion for supporting said storage caddy in a selected position, a shelf portion for supporting selected personal care products, and a hanger or article receiving and retaining portion for supporting articles suspended therefrom. The hanger or article receiving and retaining portion includes a pair of spaced apart elongated hanger members for supporting at least a portion of selected personal care products. The spaced apart elongated hanger members are adapted to support thereon at least a portion of a personal care product of the type that can be selectively oriented in a position to engage and be supported by said hanger members or in a position to pass through the enclosed space therebetween for insertion or removal. The elongated hanger members include a discontinuity, such as an obstruction or recess, formed therein to inhibit reorientation of the selected personal care product from the hanger engaging position to the pass through position and the resultant inadvertent disengagement thereof from the caddy.

More specifically, a storage caddy incorporating the present invention includes a support portion such as a frame, one or more shelf portions formed integrally with, or connected to the frame, and one or more hanger portions formed integrally with, or connected to the frame. The frame, shelves and hanger are often formed from elongated members, such as, for example, all plastic or plastic coated metal wires. The storage caddy incorporating the present invention is adapted to be supported in various ways, such as by hanging from a shower head pipe or by attachment to another support such as a wall It may also be self supporting and free standing.

Thus in addition to one or more shelves or article supporting surfaces for personal care articles such as bars of soap and/or containers of shampoo and the like, a storage caddy in accordance with the present invention also incorporates one or more hangers or article receiving and retaining members not only capable of acting as a hanger or hook for hanging articles such as cloths, but also is adapted to support and retain articles that would otherwise be easily dislodged therefrom, such as razors.

The article receiving and retaining members not only act as do existing hangers to receive and support articles that may be hung therefrom such as cloths and articles on loops of flexible material (e.g., soap on a rope), but also support and retain selected personal care articles of the headed type, e.g., razors, which when placed on existing hangers tend to be easily dislodged. The article receiving and retaining portions forming part of the caddies incorporating the present invention may take the form of a pair of spaced apart elongated hanger members spaced from each other to define therebetween a space into which a first or handle portion of a selected article may pass while providing support for another or head portion of the selected article. The spacing between the hanger members and the length thereof are selected to allow the head portion of selected personal care article, e.g., razors, to pass between the elongated hangers when the head portion is rotated from a support orientation, e.g., transverse to the elongated hanger members, in which it rests on the elongated hanger members, to a second release orientation, e.g., parallel to the hanger members in which it can pass between the elongated hanger members.

In accordance with the present invention the elongated hanger members include a discontinuity which interacts with the personal care product supported thereon to inhibit inadvertent orientation thereof into the release or pass through position and which thereby reduces the likelihood of inadvertent disengagement thereof from the caddy. The discontinuity, such as an obstruction or recess is located to preclude accidental rotation of the supported portion, e.g., the head portion, from the supported position, while permitting intentional rotation and removal or insertion thereof.

Numerous other advantages and features of the present invention will become readily apparent from the following detailed description of the invention and the disclosed embodiment thereof, from the claims, and from the accompanying drawings in which the details of the invention are fully and completely disclosed as apart of this specification.

DETAILED DESCRIPTION OF A PREFERRED EMBODIMENT

Figure 1:
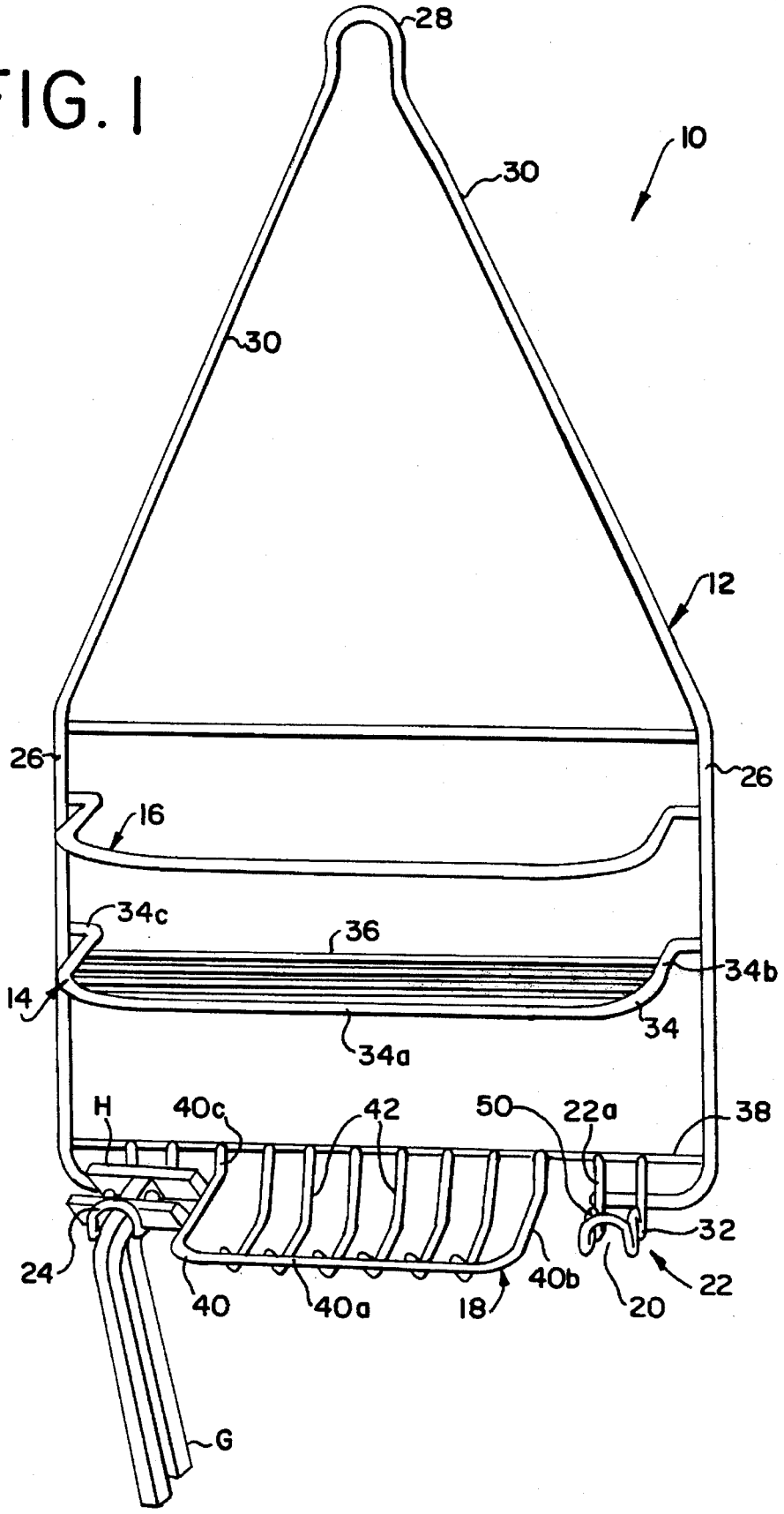
FIG. 1 is a perspective view of a storage caddy for personal care products incorporating the present invention.

While this invention is susceptible of embodiment in many different forms, there is shown in the drawing and will be described herein in detail, a specific embodiment thereof, with the understanding that the present disclosure is to be considered as an exemplification of the principles of the invention and is not intended to limit the invention to the specific embodiment illustrated.

One embodiment of a storage caddy 10 for personal care products incorporating the present invention is shown in the drawing and takes the form of a shower caddy adapted to be hung from the shower head pipe as is well known. The storage caddy 10 includes a support portion or frame 12, a first upper shelf 14 and an associated retaining ring 16 located above the first upper shelf 14 and spaced therefrom, a second lower shelf 18, and a pair of substantially identical generally U-shaped hanger elements or article receiving and retaining portions 20. Each hanger or article receiving and retaining portion 20 is formed by a pair of elongated hanger members or legs 22 of finite length and a closed base portion 24 extending between one end of the elongated legs 22.

As shown in the drawing, the storage caddy 10 and its components are formed of relatively rigid wire or rod coated with a plastic material such as vinyl, as is well known. As used herein, wire shall include such coated wires and variations thereof. The storage caddy 10 could also be made of all plastic, such as illustrated in U.S. Pat. No. 4,573,591.

The frame 12 of the storage caddy 10 is formed from a single piece of wire having lower, generally parallel legs 26, oriented generally vertically when the caddy is in place, an upper generally inverted U-shaped retaining or gripping portion 28, and intermediate flaring leg portions 30 extending between the lower legs 26 and the gripping portion 28 as shown. The bottom free ends 32 of the lower legs 26 are turned inwardly towards each other. The illustrated configuration is only one of many possible storage caddy configurations. For example, if the storage caddy is not to be hung from a shower pipe, the upper gripping portion can be omitted, while some other support configuration could be utilized. In addition the relative lengths and shapes of the various portions of the frame 12 can be varied without departing from the principals of the present invention.

The upper shelf 14 is formed by a generally U-shaped frame 34 having a central front portion **34*a* which merges at either end into a pair of side portions 34*b* oriented generally transverse thereto. The rear ends 34*c* of the side portions 34*b* are flared outwardly for engagement with and attachment to the lower legs 26 of the frame 12. A plurality of shelf wires 36 extend laterally between and are attached to the side portions 34*b* of the frame 34 of upper shelf 14. Since he upper shelf 14 is often used to support bottles and other containers, the retaining ring 16, the shape of which substantially the same as the frame 26 of upper shelf 14, is attached to the lower legs 26 a at a position above the upper shelf 14**.

A support brace 38 for the lower shelf 18 and the article receiving and retaining members 20 extends between and is attached to the lower legs 26 of the frame 12 at a position spaced above the turned in ends 32. The lower shelf 18 which is normally used for objects such as bars of soap is formed by a generally U-shaped frame 40 having a central front portion **40*a* which merges at either end into a pair of side portions 40*b* oriented generally transverse thereto. The rear ends 40*c* of the side portions 40*b* taper up and are attached to the support brace 30. A plurality of shelf wires 42 extend rearwardly from and are attached to the central front portion 40*a* of generally U-shaped frame 40. The rear ends of the shelf wires 42 taper up and are attached to the support brace 30**.

The caddy 10 includes a pair of article receiving and retaining elements 20 located on either side of the lower shelf 18. The article receiving and retaining elements 20 are each generally U-shaped and are shown as being identical to each other, although that is not mandatory. The U-shaped article receiving and retaining members 20 are each formed by the pair of elongated legs or hanger members 22. The front ends of the legs 22 merge into a central generally U-shaped base portion 24 which extends therebetween. The back ends 22*a* of the elongated legs 22 are bent upwardly and are attached to the support brace 38 and the turned in ends 32 of lower legs 26 of the frame 12. The front portions of the elongated legs 22 are also bent upwards to form together with base portion 24 an abutment and hook 48.

Each of the elongated legs 22 include a discontinuity formed therein intermediate the ends thereof. As shown in the drawing, the discontinuity in each leg 22 may take the form of a upward projection or abutment 50. The area between the projection or abutment 50 and the support brace 30 of each leg 22, and the area between the projection or abutment 50 and the hook 48 of each leg 22 define article receiving recesses 52, 54, respectively.

As shown in the drawing, the enclosed space 56 defined between the legs 22 on either side, the U-shaped base portion 24 at the front and the brace 30 and turned in ends 32 in the rear is sufficiently narrow to permit the top or head portion H of selected personal care articles, such as razors to rest on the legs 22 and be supported thereby. The enclosed space 56 is sufficiently wide, however, to allow the handle or gripping portion G to pass between the legs 22. The articles may be supported in each of the recesses 52, 54 between the upturned front end hook 48 and the projections or abutments 50, or between the projections or abutments 50 and the upwardly bent rear ends 22*a* of the legs 22.

Figure 3:
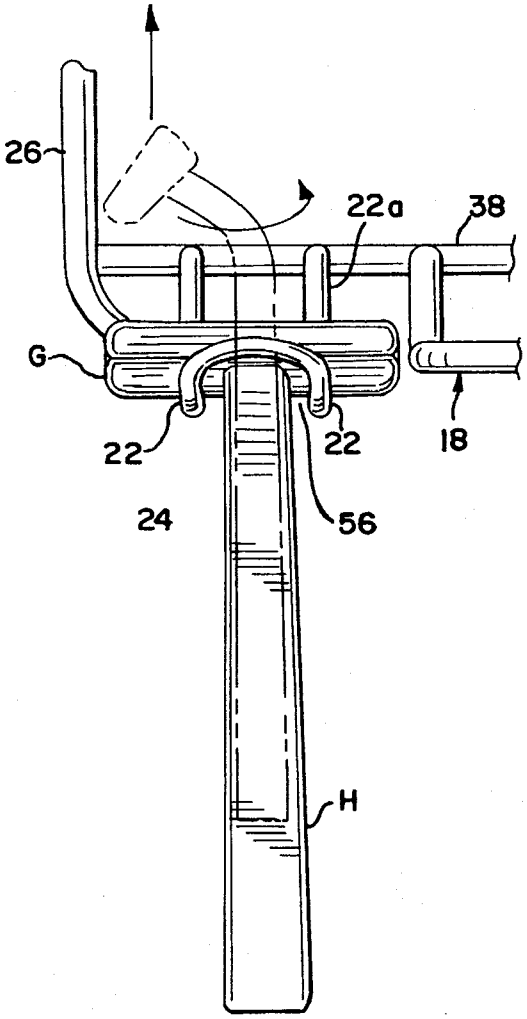
FIG. 3 is a enlarged partial front view showing the hanger or article receiving and retaining member forming part of the storage caddy of FIG. 1.
Figure 2:
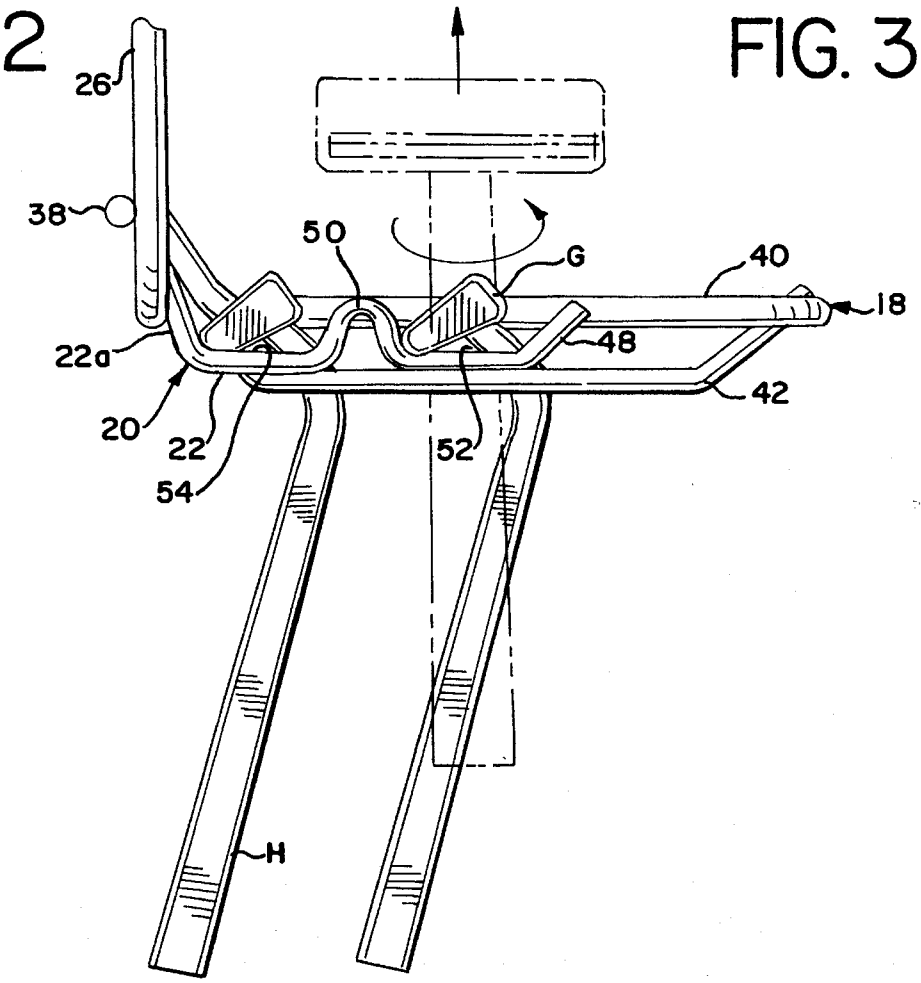
FIG. 2 is a enlarged partial elevational view showing the hanger or article receiving and retaining member forming part of the storage caddy of FIG. 1.

Since the enclosed space 56 is not obstructed by the discontinuity 50 formed in each leg 22 or otherwise, the articles and be grasped and rotated as indicated by the arrows in FIGS. 2 and 3 for easy removal and insertion of the articles through the enclosed space 56.

The article receiving and retaining elements 20 are multifunctional in that they can also be used as hooks or hangers for other articles, such as wash cloths, in the same manner as hooks on existing caddies are utilized. In this manner, the improved additional capabilities of retaining articles such as razors and inhibiting inadvertent dislodgement thereof, which previously have not been properly stored, is achieved without forfeiting other existing capabilities.

Thus there has been disclosed a storage caddy incorporating the capability of safely storing articles that previously tended to be dislodged while permitting easy and convenient storage and removal thereof while inhibiting accidental and unintended dislodgement.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

I claim:

1. A storage caddy for personal care products comprising:

a support portion for supporting said storage caddy in a selected position;

a shelf portion for supporting personal care products; and an article receiving and retaining portion for supporting selected personal care products suspended therefrom, said article receiving and retaining portion including a pair of spaced apart elongated hanger members for supporting thereon at least a portion of selected personal care products of the type that can be selectively oriented in a position to engage, be supported by and rest on said hanger members or in a position to pass through the enclosed space therebetween for removal or insertion;

said elongated hanger members including a discontinuity formed therein to inhibit reorientation of the selected personal care product from the hanger engaging position to the pass through position and thereby inhibit the resultant inadvertent disengagement of the selected personal care product from the caddy;

said elongated hanger members are oriented transverse to said frame portion;

a first end of each of said elongated hanger members is connected to said frame portion to define said enclosed space therebetween; and a second end of each of said elongated hanger members is connected to each other to close the other end of said enclosed space therebetween.

2. A storage caddy for personal care products in accordance with claim 1 wherein:

the length of said enclosed space from said frame portion to the other end thereof is sufficiently long to permit passage of the reoriented selected personal care product therethrough.

* * * * *